US007712323B2

(12) United States Patent
Villani

(10) Patent No.: US 7,712,323 B2
(45) Date of Patent: May 11, 2010

(54) DEVICE FOR PRODUCING ICE CUBES IN A REFRIGERATOR

(75) Inventor: Pietro Villani, Turin (IT)

(73) Assignee: Elbi International S.p.A., Turin (IT)

( * ) Notice: Subject to any disclaimer, the term of this patent is extended or adjusted under 35 U.S.C. 154(b) by 579 days.

(21) Appl. No.: 11/534,027

(22) Filed: Sep. 21, 2006

(65) Prior Publication Data

US 2007/0068189 A1 Mar. 29, 2007

(30) Foreign Application Priority Data

Sep. 23, 2005 (IT) ..... TO2005A0665

(51) Int. Cl.

| | |
|---|---|
| ***F25C 1/00*** | (2006.01) |
| ***F25C 1/22*** | (2006.01) |
| ***F25C 1/14*** | (2006.01) |
| *G05D 23/32* | (2006.01) |

(52) U.S. Cl. ..... 62/233; 62/135; 62/157; 62/340; 62/353; 62/354

(58) Field of Classification Search ..... 62/233, 62/353, 340

See application file for complete search history.

(56) References Cited

U.S. PATENT DOCUMENTS 4,604,504 A * 8/1986 Stout et al. ..... 200/38 B
4,665,708 A * 5/1987 Tate et al. ..... 62/66
4,697,432 A * 10/1987 Cole ..... 62/233
4,866,948 A * 9/1989 Cole ..... 62/233
4,980,523 A * 12/1990 Aigner et al. ..... 200/38 R
5,261,248 A * 11/1993 Willis et al. ..... 62/137
5,652,418 A * 7/1997 Amonett ..... 200/38 B
5,889,243 A * 3/1999 Edwards et al. ..... 200/35 R
6,112,540 A * 9/2000 Serrels et al. ..... 62/351
6,727,440 B1 * 4/2004 Wen et al. ..... 200/38 R
7,146,820 B2 * 12/2006 Comerci et al. ..... 62/137

* cited by examiner

*Primary Examiner*—William E. Tapolcai
*Assistant Examiner*—Filip Zec
(74) *Attorney, Agent, or Firm*—Sughrue Mion, PLLC

(57) ABSTRACT

The device comprises a basin-like container in which partitioning baffles define a plurality of cavities or moulds open at the top, intended to hold a respective quantity of water put into them by means of a solenoid valve, for the formation of corresponding ice cubes. An ejection device includes an electric motor device to which a rotatable shaft is coupled, from which stretch a plurality of ejector elements capable of provoking the expulsion of the ice cubes formed in said cavities or moulds as an effect of the rotation of the shaft.

Control devices are associated with the motor device and with the solenoid valve, and comprise two cams operatively driven in rotation by the motor at different speeds. These cams have respective enabling and control profiles engaged operatively by the same feeler that cooperates with an electric switch in such a way as to define, in the operating cycle of the device, at least one time interval of predetermined duration for the opening of said water feed solenoid valve.

2 Claims, 5 Drawing Sheets

DEVICE FOR PRODUCING ICE CUBES IN A REFRIGERATOR

This invention relates to a device for producing ice cubes in a refrigerator.

More specifically, the object of the invention is a device for producing of ice cubes, of the type comprising a basin-like container in which partitioning baffles define a plurality of cavities or moulds open at the top, intended to hold a respective quantity of water put into them by means of a feed solenoid valve for the formation of corresponding ice cubes;

an ejection device, that includes an electric motor borne on a support structure, and to which a shaft is coupled rotatably with respect to the container, from which stretch a plurality of ejector elements capable of extending into said cavities or moulds and provoking the expulsion of the ice cubes formed in said cavities or moulds as an effect of the rotation of said shaft; and means of control associated with the motor and with said water feed solenoid valve, and comprising a rotating element, operatively driven in rotation by the motor at a predetermined speed and cooperating with associated electric switching means in such a way as to define a predetermined operating cycle including at least one time interval of predetermined duration for the opening of said water feed solenoid valve.

Devices of this type are known, in which the means of control comprise a rotating disc bearing a plurality of electrically conducting tracks, operatively sliding against associated stationary electric contacts for the sequential activation of the various devices and components.

In these known devices, the duration of the time interval for opening the water feed solenoid valve is defined by the angular extension of one of these conducting tracks borne by the rotatable disc.

To obtain a fairly precise setting of the duration of the opening time interval of the water feed solenoid valve, at least one end of this conducting track is cut in a non-radial direction, and the position of the associated stationary electric contact intended to explore this track is radially adjustable, in an absolutely manual manner, by means of a screw device.

The known devices are therefore structurally complex and require a setting operation at the end of the production line.

The purpose of this invention is to overcome the problems outlined above in devices according to the prior art.

This and other purposes are realized according to the invention with a device of the type defined initially, characterized by the fact that the above-mentioned means of control comprise a first and second cam element, coaxial and adjacent to one another, mounted rotatably with respect to the above-mentioned support structure and coupled to the motor in such a way that they rotate in operation at a first and, respectively, at a second speed, of which the second is higher than the first;

a feeler element which engages the profiles of said cam elements and is oscillatable around an axis essentially parallel to their axis of rotation, and cooperates with an associated electric switch controlling the opening of said water feed solenoid valve;

the first and second cam elements having at least one enabling profile and, respectively, a control profile the conformation of which is suitable for allowing the feeler to tend to place itself in a position in which it controls the opening of the water feed solenoid valve; the speed of the cam elements and the angular extensions of their respectively enabling and control profiles being such that with every revolution of the first cam element the control profile of the second is engaged by the feeler at least once in a time interval falling within the time interval in which the feeler engages the enabling profile of the first cam element;

the arrangement being such that the feeler is capable of assuming the abovementioned position of control of the opening of the water feed solenoid valve when it simultaneously engages the enabling and control profiles of the first and second cam element.

In the devices according to the invention it is not therefore necessary to carry out any adjustment operation at the end of the production line.

Further characteristics and advantages of the invention will appear from the detailed description which follows, which is purely exemplificative and not limitative, with reference to the attached drawings, in which.

Figure 1:
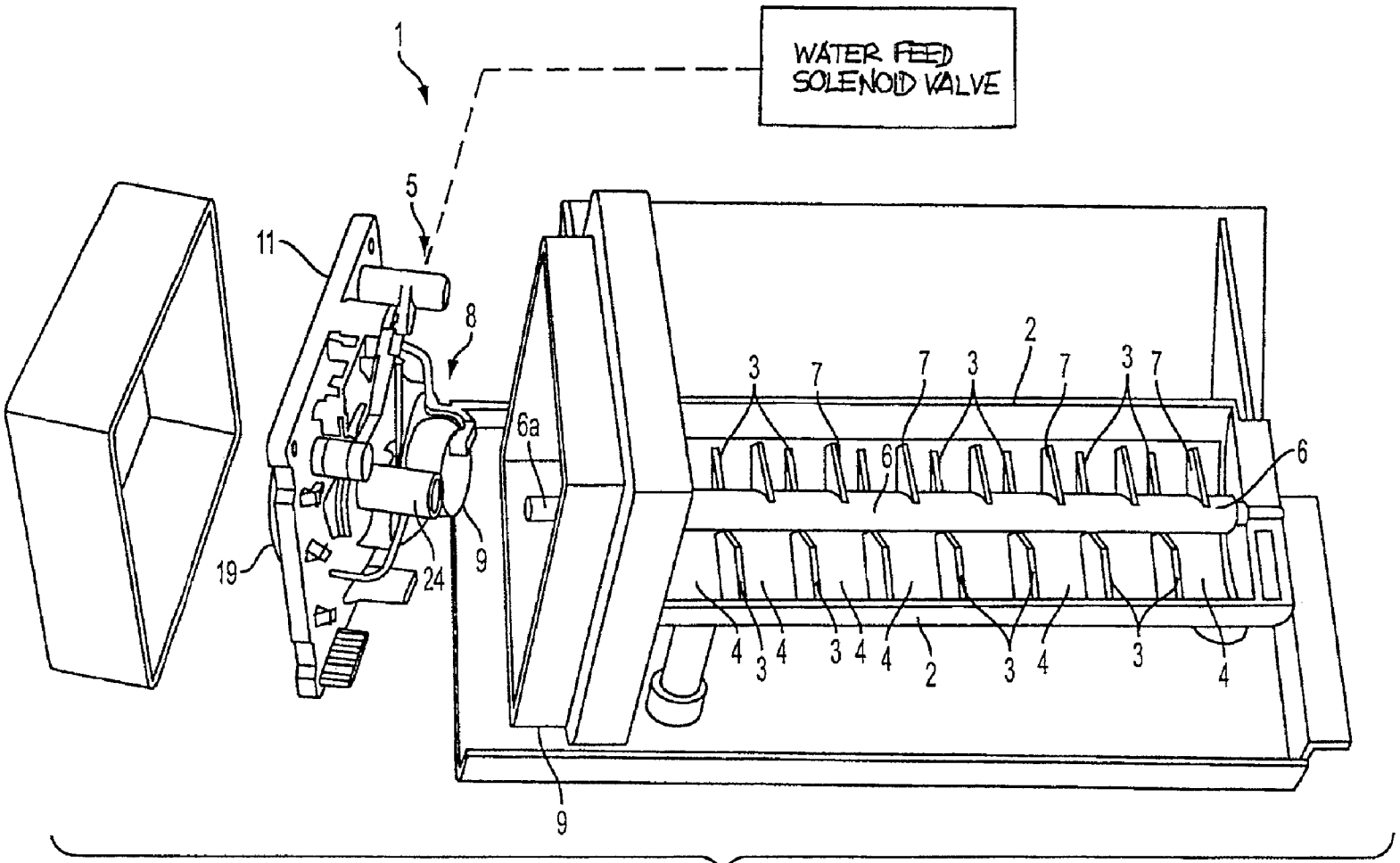
FIG. 1 is a perspective view, partly exploded, of a device according to the invention.

In FIG. 1, 1 indicates the entire device according to the invention for the production of ice cubes in a refrigerator (not illustrated).

The device 1 comprises a basin-like container 2 with an elongated form, in which a plurality of parallel partitioning baffles 3 defines a corresponding plurality of cavities or moulds 4, open at the top.

In a manner known per Se, the cavities or moulds 4 of the container 2 are intended to contain a respective quantity of water supplied by means of a solenoid valve of the on-off type for the formation of corresponding ice cubes.

In a manner known per se and not represented, an electric resistance heater device is also associated with the container 2.

The container 2 can be realized, for example, with a metal material, such as an aluminium-based alloy, and the electric heater device can conveniently be a resistance heater arranged in a heat exchange relationship along the external surface of the container 2.

Alternatively, the container 2 can be realized with a plastic material.

The electric heater device can be realized with a layer of electrically resistive ink, deposited by means of a printing process, screen-printing for example, on the surface (preferably the internal one) of the container 2.

In any case, this electric heater device is intended, when activated, to provoke the detachment of the ice cubes from the wall of the respective cavities or moulds 4, with a view to their subsequent expulsion.

The device 1 can also comprise an electric temperature sensor associated with the container 2. This sensor, which is not visible in the drawings, can for example be a resistive filament resistor with a negative temperature coefficient (NTC).

Associated with the container 2 is an ejection device indicated overall by 5 in FIG. 1.

This device comprises a shaft 6, supported in a rotatable manner with respect to the container 2. Extending from the shaft 6 is a plurality of ejector elements 7, protruding transversally, capable of extending themselves into the cavities or moulds 4 in the container 2 and provoking the expulsion of the ice cubes formed in them as an effect of the rotation of the shaft 6.

The ejection device 5 also comprises a motor device, indicated overall by 8. This device includes an electric motor 9, of the type known per se, for example a synchronous alternating current electric motor, coupled with the shaft 6 by means of a gear speed transmission indicated overall by 10.

Figure 2:
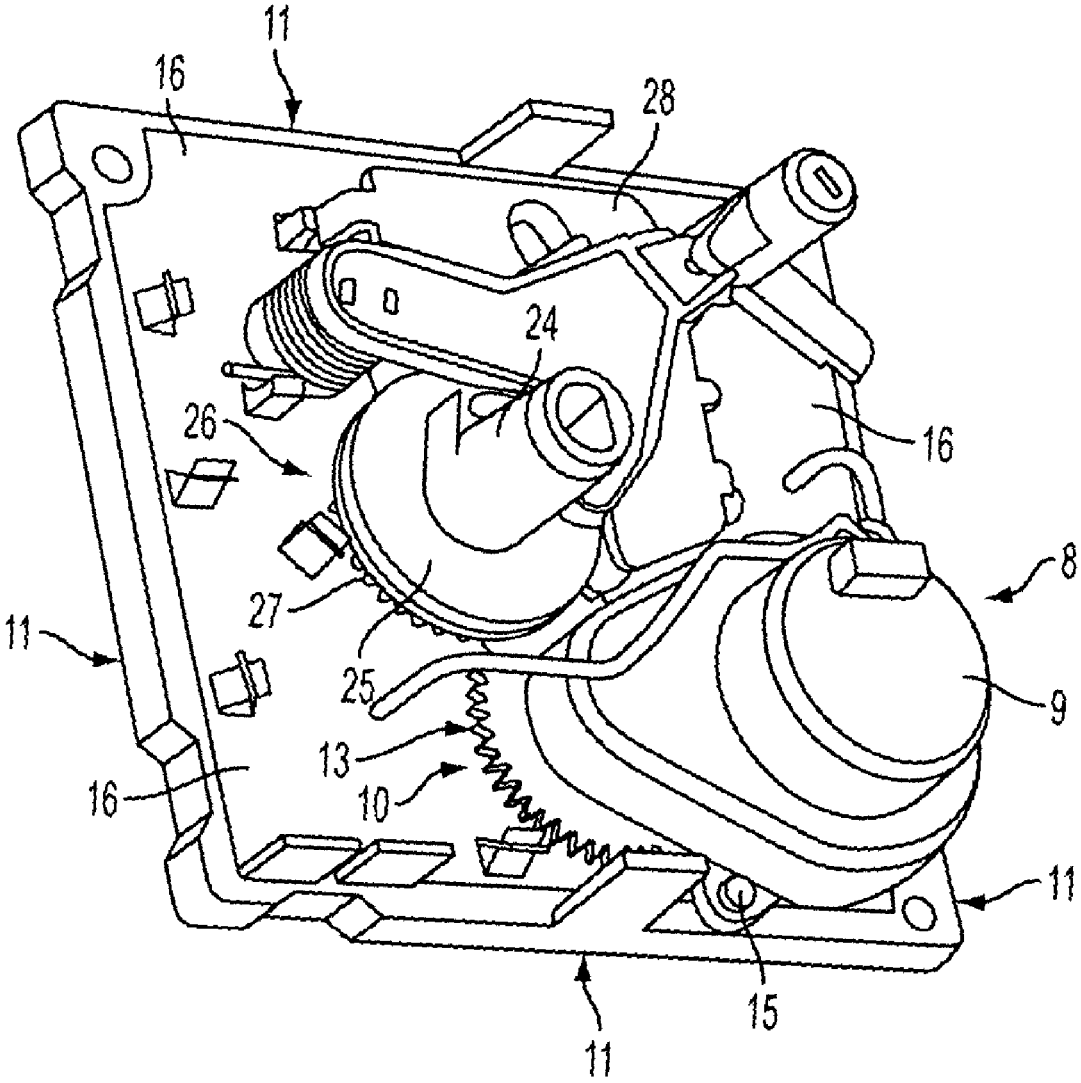
FIG. 2 is a partial perspective view showing part of the device according to FIG. 1.
Figure 3:
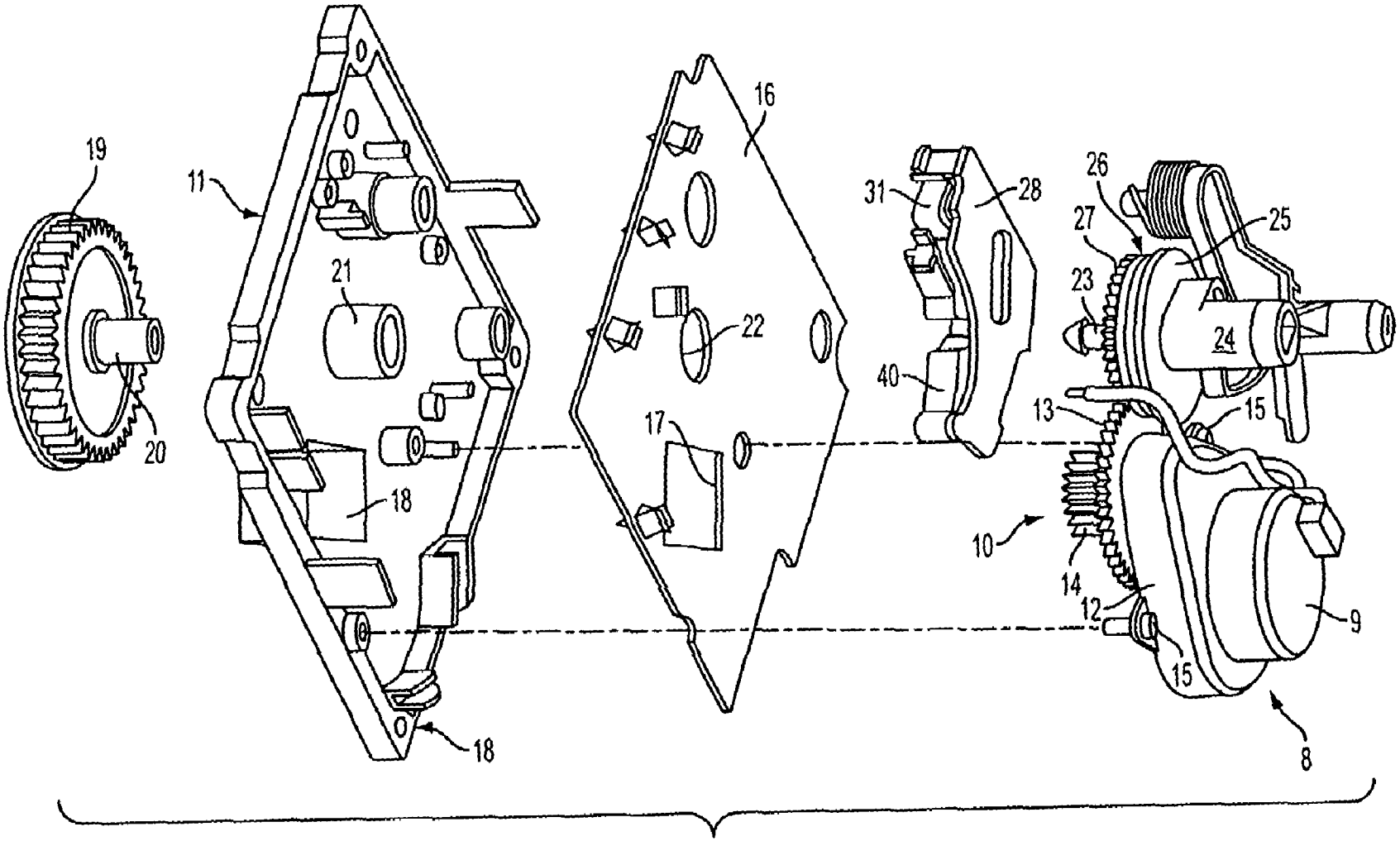
FIG. 3 is an exploded perspective view of the part of the device illustrated in FIG. 2.
Figure 4:
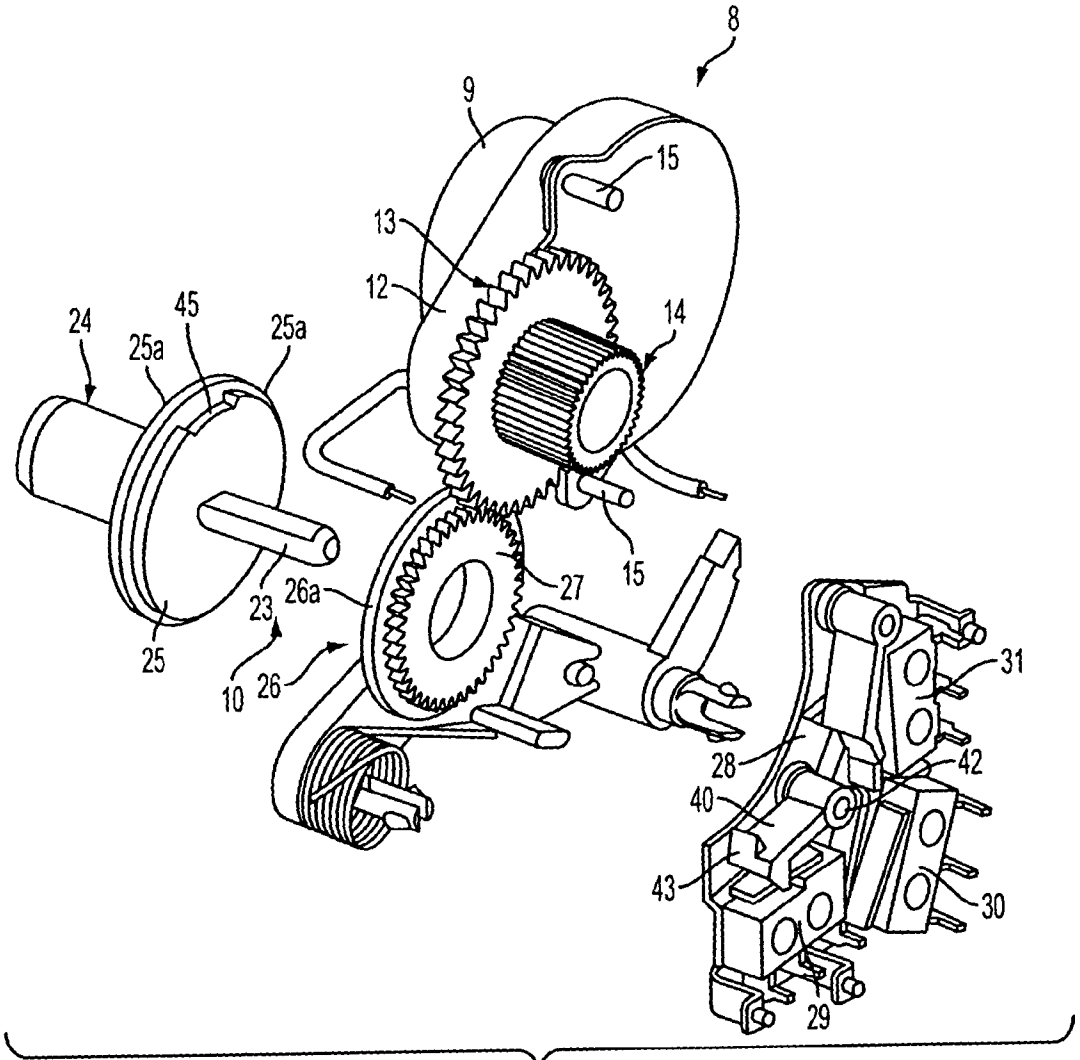
FIG. 4 is a partly exploded view of a sub-assembly of the device according to the previous figures.
Figure 5:
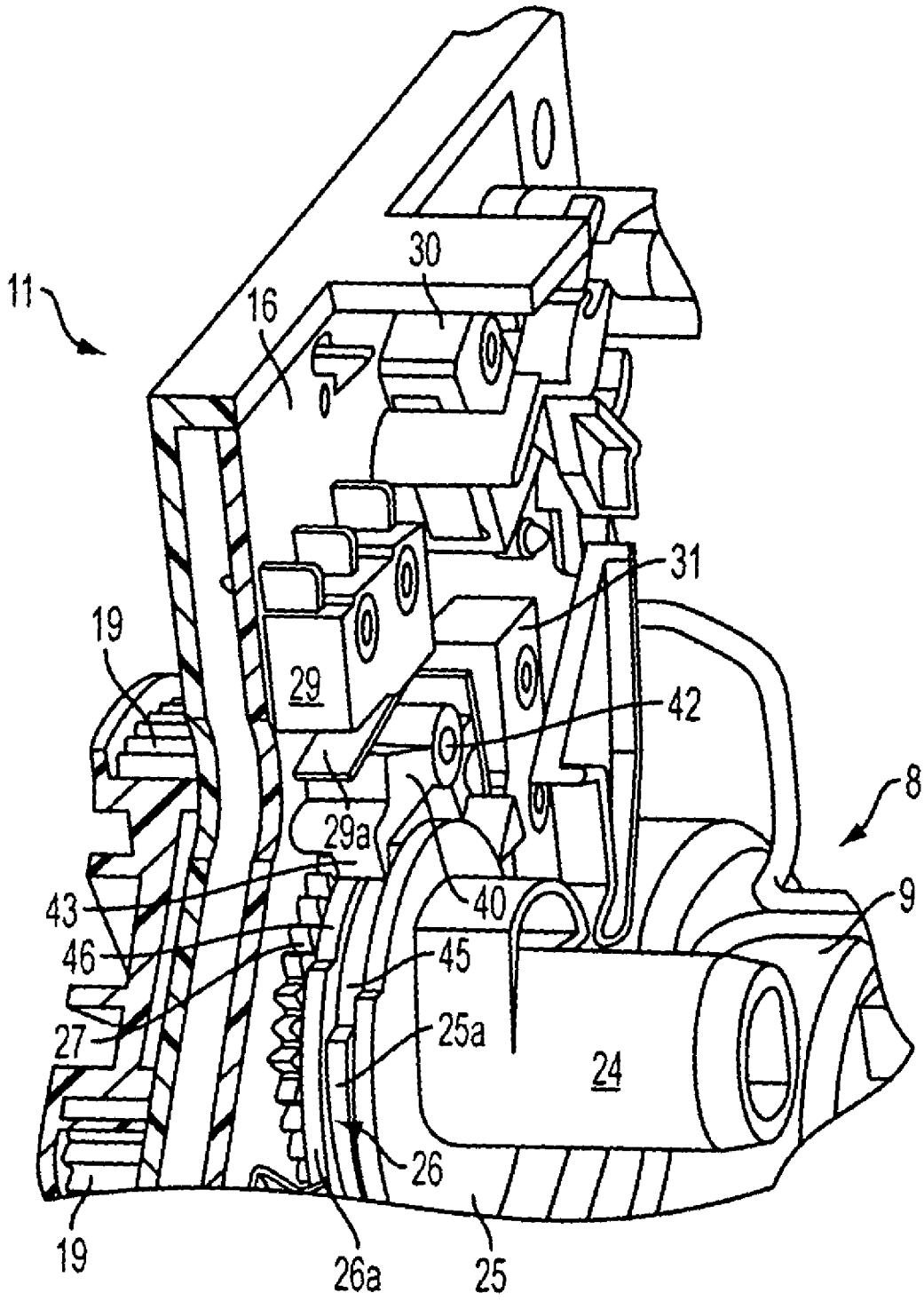
FIG. 5 is a partial perspective view, partly sectioned, and on an enlarged scale, of part of the device according to the previous figures.

With reference in particular to FIGS. 1-3 and 5, the motor device 8 is borne by a support structure 11 (see FIG. 3 in particular), for example of a moulded plastic material. In particular, the electric motor 9 is coupled to a gear speed reducer 12 which has a toothed output wheel 13 coaxial and integral with a toothed sprocket 14 with a smaller diameter. The assembly formed by the electric motor 9 and by the associated speed reducer 12 is fixed to the support structure 11 by means of screws 15 (FIGS. 3 and 4), with the interposition of a printed circuit board 16, provided with a plurality of openings, one of which (indicated by 17 in FIG. 3) is penetrated by the toothed sprocket 14. This sprocket also extends through a corresponding opening 18 of the support structure 11, beyond which it engages with a toothed wheel 19 with an increased diameter (FIGS. 3 and 5).

The toothed wheel 19 has a hub 20 (FIG. 3) supported in rotation in an integral bushing 21 of the support structure 11. This hub extends through an opening 22 of the printed circuit board 16 (FIG. 3) and is torsionally coupled with an axial tang 23 (FIGS. 3 and 4) of a driving element 24 which, as can be understood by observing FIG. 1, is coupled rotatably with one end 6*a* of the shaft 6.

As can be seen in particular in FIGS. 4 and 5, the driving element 24 has an intermediate formation 25, essentially disc-like, with an increased diameter, the peripheral profile of which forms cam profiles which will be better described below.

With reference to FIG. 4, 26 overall indicates a cam element, mounted rotatably around the root part of the axial tang 23 of the driving element 24, coaxially with and adjacent to the disc formation 25 of said driving element.

The cam element 26 has a peripheral cam profile, which will be better described below.

On the side opposite the driving element 24, the cam element 26 has an integral toothed wheel formation 27 which engages with the toothed output wheel 13 of the speed reducer 12 associated with the electric motor 9 (see FIGS. 3 and 4 in particular).

The diameters of the toothed wheel 13, of the sprocket 14, of the toothed wheel 19 and of the toothed gear 27 of the cam element 26 are such that during operation the driving element 24 and its cam formation or element 25 rotate at a relatively low predetermined angular velocity, while the cam element 26 is made to rotate at a relatively higher predetermined angular speed. For this reason, the cam formation or element 25 can be defined as the "slow cam" while the cam element 26 can be defined as the "fast cam".

Indicatively, the speed of the fast cam 26 can be at least four times the speed of the slow cam for example.

With reference to FIGS. 2 to 4 in particular, 28 indicates a support element fixed to the printed circuit board 16 and bearing a plurality of electric switches 29-31 (FIG. 4) on one face. These electric switches are also visible in FIG. 5 where the depiction of the support element 28 has been omitted.

Electric switch 29 in particular is intended to control the activation of the solenoid valve feeding water to the cavities or moulds 4 of the container 2.

As can be seen in FIG. 5 in particular, the switch 29 has a control lever 29*a* pushed elastically (in a manner known per se) against a feeler element 40 (FIG. 5) mounted in an oscillatable manner at one end around a pin 42 essentially parallel to the axis of rotation of the cam elements 25 and 26. The distal end of the feeler 40 has a terminal formation 43 which presses against the peripheral profiles of both the cam elements 25 and 26.

With reference to FIG. 5, the cam elements 25 and 26, slow and fast respectively, have at least one respective enabling profile, the conformation of which is suitable for allowing the feeler 40 to tend to arrange itself in a position of control of the opening of the solenoid valve feeding water to the cavities or moulds 4 of the container 2.

In the embodiment illustrated as an example, the slow cam element 25 has at least one radially protruding profile 25*a*, in which at least one interruption 45 in the circumferential direction, with an extension of about 20° for example, is defined.

The cam element 26 has a radially protruding cam profile 26*a* which also has an interruption in the circumferential direction, indicated by 46 in FIG. 5. This interruption is more extended angularly than the interruption 45 described above in relation to the fast cam element 25. Only one end of the interruption 46 of the cam profile 26*a* of the element 26 is visible in FIG. 5, the other end being "covered" by the other components of the device. As an example only, the interruption 46 can have an extension of 90°.

The terminal formation 43 of the feeler element 40 is capable of engaging both the profile 25*a* of the slow cam element 25, and the profile 26*a* of the fast cam element 26. This feeler element 40 is pushed in the direction of these profiles by the control lever 29*a* of the electric switch 29. Only when both interruptions 45 and 46 of the cam elements 25 and 26 are simultaneously facing the terminal portion 43 of the feeler element 40 can the feeler element 40 arrange itself in a position radially close to the axis of the driving element 24, in which it permits a displacement of the control lever 29*a* of the switch 29 so as to provoke the switching of the same, and therefore the opening of the water feed solenoid valve.

The adoption of the mechanism with one slow cam that defines at least one enabling time window for the water feed function, and with one fast cam that, within such a time window, defines the water supply time interval, makes it possible to reduce the imprecision in the water feed time resulting from the manufacturing tolerances of the components and from the assembly of the same, at the very least to such an extent that no adjustment device is required nor are setting operations at the end of the production line.

Naturally, without prejudice to the principle of the invention, the forms of actuation and the embodiment details can be widely varied compared with what has been described and illustrated for non-limiting exemplificative purposes only, without thereby leaving the framework of the invention as defined in the annexed claims.

What is claimed is:

1. Device for producing ice cubes in a refrigerator, comprising:

a basin-like container in which partitioning baffles define a plurality of cavities or moulds open at the top, intended to hold a respective quantity of water put into them by means of a feed solenoid valve for the formation of corresponding ice cubes;

an ejection device, that includes an electric motor device borne on a support structure and to which a shaft is coupled rotatably with respect to the container and from which stretch a plurality of ejector elements capable of extending into said cavities or moulds and provoking the expulsion of the ice cubes formed in said cavities or moulds as an effect of the rotation of said shaft; and control means associated with the motor device and with said solenoid valve, and comprising a rotating element, operatively driven in rotation by the motor device at a pre-determined speed and cooperating with associated electric switching means in such a way as to define a pre-determined operating cycle including at least one time interval of a predetermined duration for the opening of said water feed solenoid valve;

said control means comprising first and second cam elements, coaxial and adjacent to one another, mounted rotatably with respect to said support structure and coupled to the motor device in such a way that they rotate in operation at respective first and second speeds of which the second speed is higher than the first speed;

a feeler element which engages the profiles of said cam elements and is oscillatable around an axis essentially parallel to the axis of rotation of said cam elements, and cooperates with an associated electric switch controlling the opening of said water feed solenoid valve;

the first and second cam elements having respective enabling and control profiles, the conformation of which is suitable for allowing the feeler to tend to place itself in a position in which the feeler controls the opening of said solenoid valve; the speeds of the cam elements and the angular extensions of the enabling and control profiles of said cam elements being such that with every revolution of the first cam element the control profile of the second cam element is engaged by the feeler at least once in a time interval falling within the time interval in which the feeler engages the enabling profile of the first cam element;

the arrangement being such that the feeler is capable of effectively putting itself in said position of control of the opening of the solenoid valve when the feeler simultaneously engages the enabling profile of the first cam element and the control profile of the second cam element.

2. Device according to claim 1 in which said enabling and control profiles are interruptions of profiles protruding radially from the cam elements.

* * * * *